United States Patent [19]

Mueller et al.

[11] Patent Number: 4,457,348

[45] Date of Patent: Jul. 3, 1984

[54] FOOD PRODUCT FILL PUMP

[76] Inventors: Martin J. Mueller, 4520 Wonder Lake Dr.; Martin Mueller, 4949 E. Lake Shore Dr., both of Wonder Lake, Ill. 60097

[21] Appl. No.: 396,068

[22] Filed: Jul. 7, 1982

[51] Int. Cl.[3] ..... B65B 3/04

[52] U.S. Cl. ..... 141/1; 141/196; 141/25; 138/31

[58] Field of Search ..... 138/31; 141/196, 1, 141/13, 25-27, 192, 249, 392; 222/55; 17/35

[56] References Cited

U.S. PATENT DOCUMENTS 3,648,741 3/1972 Croasdale et al. ..... 141/196

3,901,279 8/1975 Schnell ..... 138/31

*Primary Examiner*—Stephen Marcus

*Assistant Examiner*—Kenneth S. Putnam

*Attorney, Agent, or Firm*—Dressler, Goldsmith, Shore, Sutker & Milnamow, Ltd.

[57] ABSTRACT

A food product fill pump apparatus and method are disclosed which greatly facilitate accurate and efficient sequential filling of containers with food product which is flowable in nature. The fill pump is adapted for use with associated packaging machinery for placing predetermined quantities of food product in a plurality of containers which are sequentially presented for filling. The fill pump includes a reciprocating positive displacement piston pump and a rotary valve which are cyclically operable for intermittent filling of the containers with a metered quantity of food product. The fill pump further includes a novel product accumulator arrangement which is adapted to compensate for surges or other fluctuations in the supply of food product to the fill pump so that the pressure of food product received by the piston pump is generally constant. The product accumulator includes an expansible chamber which is adapted to receive and discharge quantities of food product in response to fluctuations in product delivery. Automatic controls associated with the accumulator function to temporarily increase or decrease the filling speed of the apparatus when the accumulator has more or less than the desired quantity of food product therein. In this way, highly accurate quantities of food product are delivered to each of the containers being filled, thus greatly enhancing the overall efficiency and economy of the packaging operation.

22 Claims, 4 Drawing Figures

FOOD PRODUCT FILL PUMP

TECHNICAL FIELD

The present invenion relates generally to arrangements for filling containers with food product, and more particularly to an improved apparatus and method for sequentially filling a plurality of containers with food product.

BACKGROUND OF THE INVENTION

For multiple unit, high-speed packaging of liquid or semi-liquid flowable foods products, specialized packaging machinery is used which usually includes multiple pumping arrangements for placing measured amounts of food product into suitable containers. This type of machinery is typically used for packaging of food products such as yogurt, cottage cheese, ice cream, dessert toppings, and other dairy and non-dairy products which are flowable in nature.

Machinery of this description typically includes an arrangement for sequentially presenting a plurality of containers to be filled, usually in groups of several containers for simultaneous filling. Food product is supplied to the machinery from a common source, with each pumping arrangement of the machinery operating in a cyclical fashion so that the groups of containers presented are sequentially filled with product. The containers are then advanced along the production line for checking the weight of the product in the containers, and for closing and labeling the containers for subsequent storage and shipment.

Because economical production demands that each container is filled with the desired quantity of product quickly and accurately, the product pump arrangements of the packaging machinery must be capable of delivering equal amounts of food product to each container each operating cycle. Naturally, stringent sanitary conditions must be maintained throughout all steps of the product packaging operation.

One factor which can considerably complicate accurate and efficient filling of containers with food product relates to the relative compressibility of the product. While some food products are incompressible in nature, many flowable food products are compressible because the product includes air so that the product has the desired texture and consistency. Such food products are sometimes referred to as having "high overrun," and are typified by products such as ice cream, dessert toppings, and the like. Because such products are compressible in nature, filling each container with the desired quantity of product by weight is complicated, since surges in the supply of food product to the packaging machinery, changes in speed of the production line, and like fluctuations in the packaging operation can result in undesired compressing of the food product during packaging, resulting in inaccurate filling of the containers. The positive displacement type pumping arrangements used in packaging machinery for flowable food product have been found to be difficult to adjust for repeated, accurate product packaging of compressible food product in light of the inevitable fluctuations which occur in the packaging operation.

Thus, the introduction of an improved food product fill pump apparatus which is adapted for use with flowable food product which is compressible in nature, and which includes an arrangement for compensating for fluctuations which occur in the packaging operation, is particularly desirable for facilitating economical and high speed multiple unit packaging of the product.

SUMMARY OF THE INVENTION

In accordance with the present invention, an improved flowable food product fill pump is disclosed which is suited for multiple unit packaging of flowable food product, particularly product which is compressible in nature. The apparatus includes a product accumulator arrangement which is adapted to receive and discharge food product during the filling operation responsively to variations in the pressure of the product supply. Automatic controls are provided for temporarily increasing the filling speed of the apparatus when the volume of food product in the accumulator is equal to or exceeds a first predetermined volume, whereby product flows from the accumulator back into the product stream. Similarly, the controls temporarily decrease the filling speed when the volume of product within the accumulator is equal to or less than a second predetermined volume, whereby the volume of product in the accumulator increases. Normal filling speed is maintained when the volume of product within the accumulator is between the first and second predetermined volumes. In this way, the present apparatus effectively compensates for fluctuations which occur in the product packaging operation, and maintains the food product being packaged at a generally constant, uniform pressure during packaging. The resultant method of filling the containers assures accurate filling of each container with the predetermined quantity of food product. While the invention is particularly suited for use with compressible or "high overrun" food product, the apparatus and method are adapted for use for filling containers with other types of flowable food product, whether liquid or semi-liquid in nature.

The product fill pump apparatus of the present invention includes a pump housing having a product inlet portion adapted to receive a generally continuous supply of food product from an associated source. The pump housing further includes a product outlet portion which is adapted to deliver the food product to each container sequentially or serially presented to the pump for filling.

The present fill pump apparatus further includes a cyclically operable, positive displacement reciprocating piston pump associated with the apparatus housing. The displacement of the pump generally corresponds to the volume of the quantity of food product to be placed in each container, so that the displacement of the pump in one direction fills it with food product, while displacement of the pump in the opposite direction forces the food product from the pump.

In order to repeat the fill and discharge cycle for the piston pump, the fill pump apparatus includes a cyclically operable rotary valve disposed within the pump housing generally intermediate the housing inlet and outlet portions, and in alignment with the reciprocating piston pump. The rotary valve and piston pump operate cyclically in timed relation to each other so that the piston pump is alternately placed in communication with the product inlet portion and the product outlet portion of the fill pump housing. In this way, the apparatus operates so that the piston pump cyclically receives food product from the inlet portion, and thereafter forces the food product through the outlet portion.

The present fill pump apparatus includes a unique arrangement for equalizing or regulating pressure fluctuations which typically occur in the supply of food product to the fill pump. The apparatus includes a product accumulator which communicates with the product inlet portion of the pump housing, and which is adapted to maintain the pressure of food product within the inlet portion generally constant. The product accumulator comprises an expansible chamber defined by an accumulator piston reciprocably disposed within a bore defined by an accumulator cylinder, with the chamber communicating with the product inlet portion of the fill pump housing.

The accumulator further includes a biasing fluid actuator associated with the accumulator piston. The actuator functions to exert a predetermined biasing force on the expansible chamber of the accumulator. In this way, surges or other increases in the pressure of product supply to the fill pump apparatus result in product entering the expansible chamber of the accumulator against the force of the actuator so that the pressure of the product received by the positive displacement piston pump of the apparatus is generally constant. Conversely, a decrease in the pressure of the food product supply to the fill pump permits the predetermined force of the actuator to return food product in the expansible chamber back to the inlet portion of the pump housing, again acting to maintain the desired constant pressure of product received by the piston pump. This unique, continuous self-compensating action provided by the present fill pump apparatus represents a significant improvement upon previously known arrangements, and is particularly effective in accurately packaging flowable food product which is compressible in nature.

The product accumulator further includes an automatic control arrangement which operates to selectively, temporarily increase or decrease the filling speed of the apparatus above or below its normal filling speed. The automatic controls include a switching arrangement operated by an elongate member carried by the accumulator piston, the elongate member triggering the switching arrangement for automatic filling speed control.

The automatic controls are also operatively associated with the other mechanisms of the product fill pump apparatus and the overall product fill line. The controls operate to increase the speed of the sequential filling of containers by the apparatus and the fill line when a first predetermined maximum volume of food product is received within the expansible chamber of the accumulator. The increased filling speed is maintained until the biasing action of the accumulator actuator forces product from the expansible chamber so that the volume of product within the chamber is reduced to below the first predetermined maximum volume. The controls then signal the pump apparatus and other equipment of the fill line to resume normal filling speed.

Similarly, the automatic controls function to decrease the filling speed of containers when the volume of product within the accumulator is at or below a second predetermined volume. Food product thereby begins to flow into the expansible chamber of the accumulator in opposition to the force of the biasing accumulator actuator. The decreased filling speed is maintained until the volume of product within the chamber is increased to above the second predetermined volume. The controls then signal the apparatus and fill line to resume normal filling speed. Thus, the arrangement operates at normal filling speed whenever the volume of food product within the expansible chamber of the accumulator is between the first and second predetermined volumes. At normal filliing speed, the volume of product within the accumulator varies responsively to fluctuations in the pressure of the food product supply, with the force exerted on the expansible chamber of the accumulator by its actuator generally corresponding to the desired pressure of the product being introduced into the reciprocating pump of the apparatus.

This arrangement has been found to be very effective for maintaining the food product being packaged at a uniform pressure. Fluctuations in the delivery of food product to the fill pump apparatus are compensated for by "accumulating" excess product within the product accumulator of the fill pump, and then selectively returning the accumulated product into the product stream for subsequent delivery to the containers being filled. Accurate quantities of food product are delivered to each of the containers being filled in an efficient fashion, with resultant decrease in product waste and production line downtime.

Numerous other advantages and features of the present invention will become readily apparent from the following detailed description of the invention and embodiment thereof, from the claims and from the accompanying drawings in which like numerals are employed to designate like parts throughout the same.

DETAILED DESCRIPTION

Figure 1:
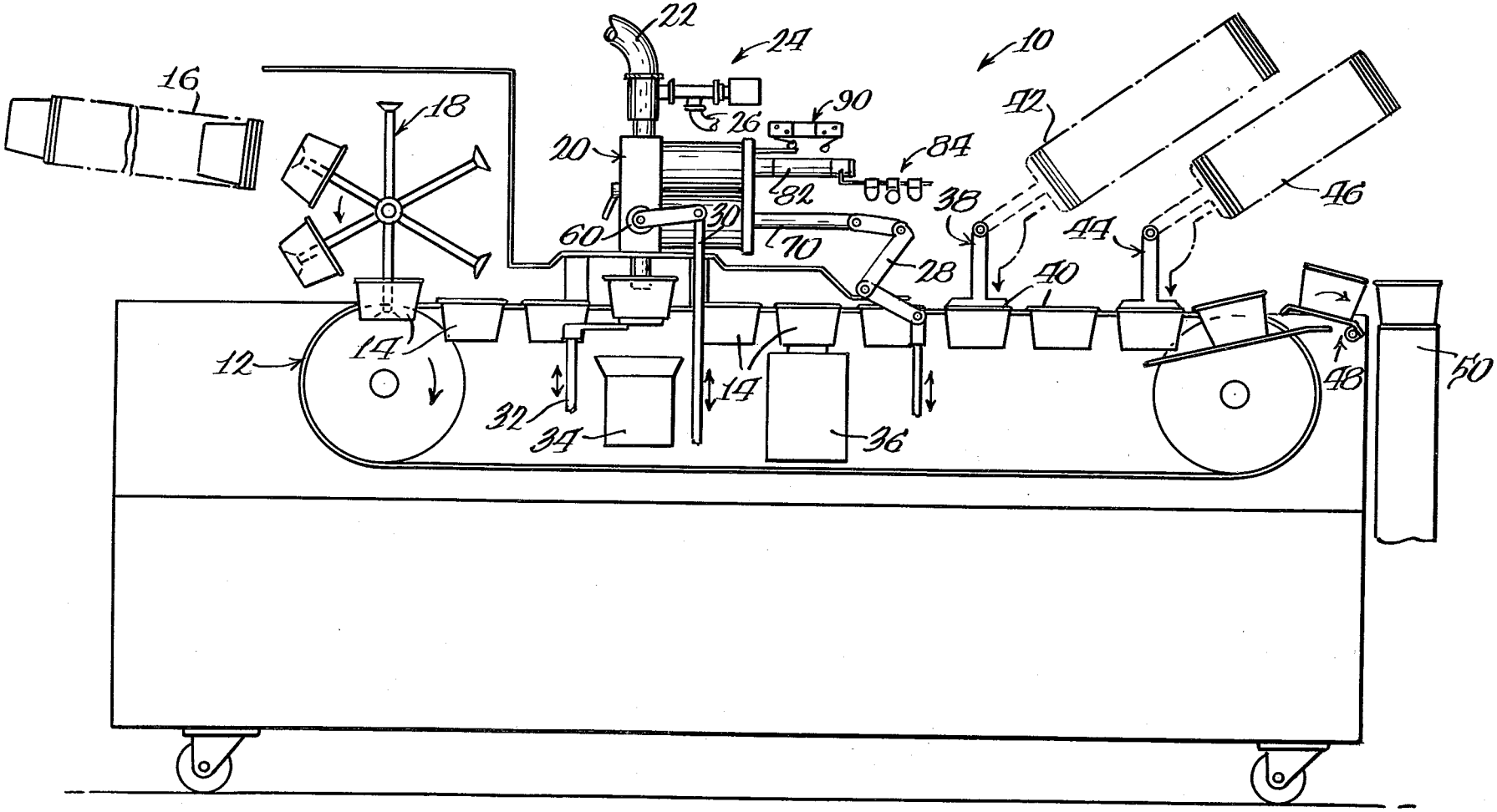
FIG. 1 is a diagrammatic side elevational view of a food product fill line employing the fill pump apparatus of the present invention.

While the present invention is susceptible to embodiment in various forms, there is illustrated in the drawings and hereinafter described the presently preferred embodiment, with the understanding that the present disclosure is to be considered as an exemplification of the invention and is not intended to limit the invention to the specific embodiment illustrated.

FIG. 1 diagrammatically illustrates a food product fill line 10 incorporating the food product fill pump apparatus of the present invention. As will be appreciated by those familiar with the art, various mechanisms of the fill line 10 are of known construction, and are not described in detail herein. Additionally, a product fill line such as 10 typically is arranged so that a plurality of individual operating lines are provided in side-by-side arrangement operating in unison with each other. For example, a typical packaging operation may include several commonly mounted fill lines operating in conjunction with each other, with each receiving food product from a common source. For purposes of clarity in the present disclosure, a single food product fill line 10 and fill pump apparatus of the present invention will be described, while it will be understood that a typical installation includes a plurality of fill pumps operating in unison in side-by-side relation. As will be later described, the control mechanisms of the present invention are readily adapted for providing the desired product compensating action for packaging machinery having multiple fill pumps in accordance with the present invention.

As shown in FIG. 1, product fill line 10 includes an intermittently operable conveyor 12 for conveying containers 14 during the sequential or serial packaging operation. The containers 14 are received by conveyor 12 from an associated container stack 16 by a suitable suction-operated container transfer or feed mechanism 18. Containers 14 received by the conveyor are intermittently advanced for subsequent product filling, weighing, lid placement, labeling, and transfer from the conveyor.

Containers 14 are presented for filling by the container fill pump apparatus 20 in accordance with the present invention. Fill pump 20 receives product in a generally continuous fashion from an associated source through product supply line 22. A pressure regulator 24 communicates with supply line 22 to prevent excessive quantities of food products from being delivered to fill pump 20, and diverts such excess product to a product return line 26 for recycling.

Fill pump 20 is operated by a suitable and conventional pump operating linkage 28 and suitable and conventional valve operating linkage 30. Linkages 28 and 30 may have any of a variety of configurations as are known, with each linkage operatively associated with the drive mechanism for fill line 10 so that the various mechanisms of the fill line operate in the desired intermittent cyclic manner in timed relation to each other. Thus, as containers 14 are sequentially presented for filling, linkages 28 and 30 are appropriately operated so that a predetermined quantity of food product is received by each container from fill pump 20. In this regard, fill line 10 includes a container lift mechanism 32 for moving each container 14 toward the fill pump 20 for filling, and a drain pan 34 located underneath the fill pump for receiving any product which may drip from the fill pump during the period of time in which the next container is being presented for filling.

After being filled with food product, each container 14 is advanced by conveyor 12 to weight check station 36, where the container and its contents are weighed for quality control purposes. The containers 14 are thereafter advanced to container lid transfer mechanism 38 so that a container lid 40 is placed on each container 14. Lid transfer mechanism 38 typically comprises a suction-operated device which operates in a cyclical fashion to receive a container lid from the lid stack 42, and thereafter place the lid on one of the containers 14 carried by conveyor 12. The containers are then advanced to label transfer mechanism 44, which places a label from stack 46 on the lid of each container. Conveyor 12 then moves containers 14 to a lift and transfer mechanism 48 where each container is removed from the conveyor 12 for delivery to finished product conveyor 50 for subsequent packaging, storage, and shipment.

Figure 2:
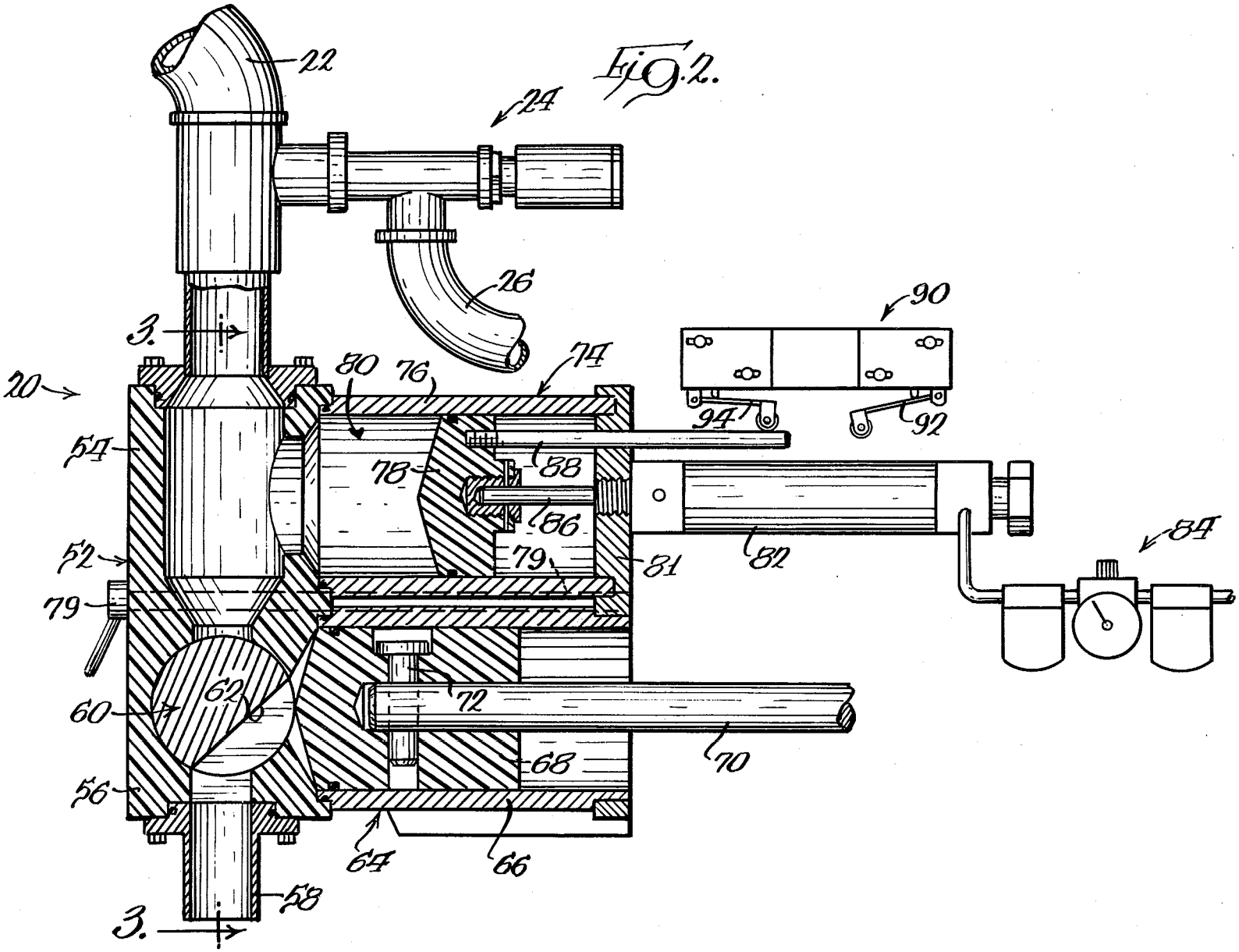
FIG. 2 is an enlarged, side elevational view, in partial cross-section of the fill pump apparatus illustrated in FIG. 1.
Figure 4:
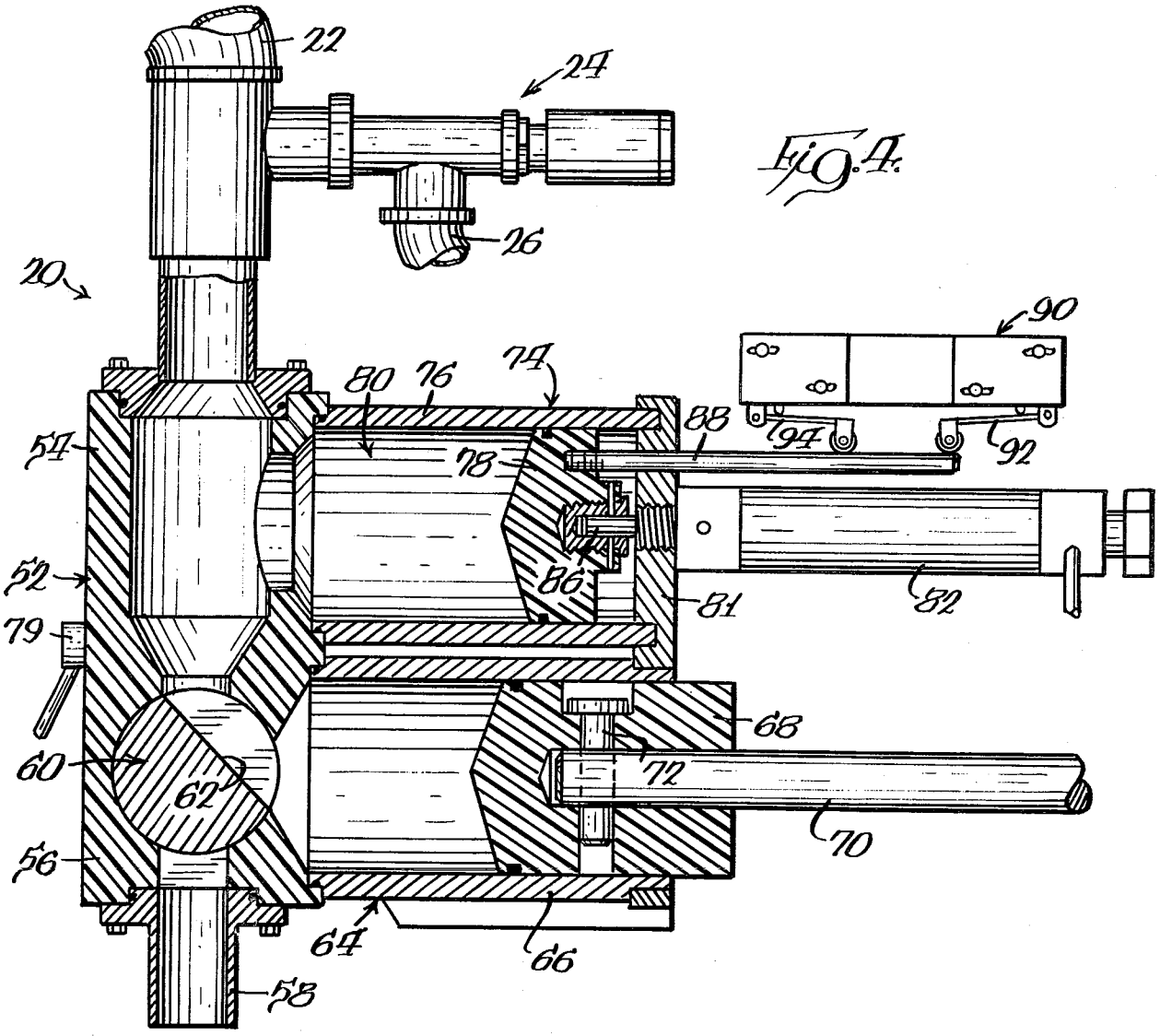
FIG. 4 is a view similar to FIG. 2 illustrating the operation of the fill pump apparatus of the present invention.
Figure 3:
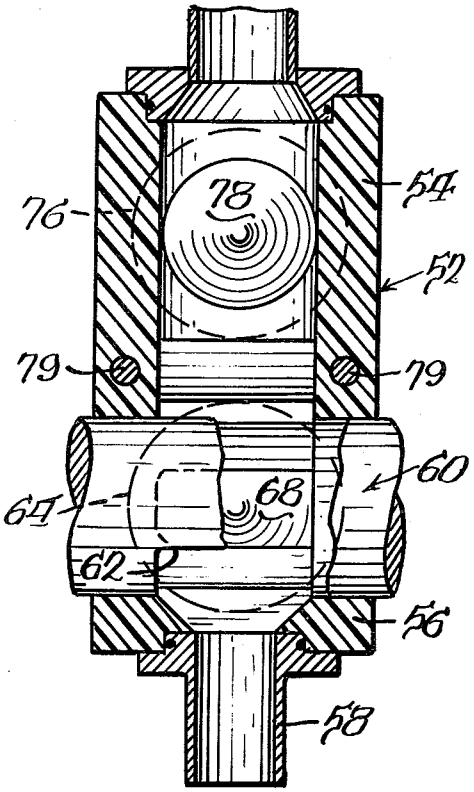
FIG. 3 is a fragmentary cross-sectional view taken generally along lines 3—3 of FIG. 2.

With reference to FIGS. 2–4, the product fill pump apparatus 20 of the present invention will now be described in greater detail. Fill pump 20 includes a generally vertically disposed pump housing 52 which may be suitably fabricated from stainless steel or so-called "dairy metal." Pump housing 52 includes an upper product inlet portion 54 which is adapted to receive the flowable food product from product inlet line 22, and a lower product outlet portion 56 through which food product is delivered to each of the containers being filled. Outlet portion 56 may be provided with an outlet nozzle 58 so that the food product is properly delivered to each of the containers.

Fill pump 20 further includes a cyclically operable rotary valve 60 disposed within pump housing 52 generally intermediate inlet portion 54 and outlet portion 56. Rotary valve 60 defines a valve cutout portion 62 to provide alternate communication between associated piston pump means 64 and inlet and outlet portions 54 and 56. Rotary valve 60 is adapted to be cyclically operated by valve operating linkage 30 illustrated in FIG. 1.

Metered delivery of food product to containers 14 by fill pump 20 is provided by a reciprocating piston pump 64 associated with the pump housing 52. Piston pump 64 is of the positive displacement type, and is cyclically operable by the pump operating linkage 28 illustrated in FIG. 1. Piston pump 64 includes a pump cylinder 66 fitted to pump housing 52 within which is reciprocably disposed pump piston 68. Piston 68 is stroked by piston rod 70, which is connected with the piston 68 by a piston pin 72.

Piston rod 70 is operatively connected with the pump operating linkage 28, and cyclically operates pump piston 68 in conjunction with the cyclical operation of rotary valve 60 so that the piston pump 64 is alternately placed in communication with product inlet portion 54 and product outlet portion 56 of pump housing 52. Thus, in a first position of rotary valve 60 (shown in FIG. 4), piston 68 is displaced in one direction so that the pump 64 fills with food product, with rotary valve 60 then moved to a second position (shown in FIG. 2) and the pump piston 68 displaced in an opposite direction for forcing food product from the piston pump 64 into and through outlet portion 56 of pump housing 52.

Pump piston 68 may be suitably fabricated from Teflon or other like non-stick materials, with pump cylinder 66 fabricated from stainless steel or like material suitable for food processing. Pump piston 68 may include suitable sealing rings or the like so that accurate quantities of food product are displaced with each stroke of the piston. Prior to operation, piston pump 64 and its operating linkage 28 are "fine tuned" so that the displacement of the pump 64 generally corresponds to the volume of the quantity of food product to be placed in each of the containers 14. To this end, as is known in the art, adjustable means may be provided in linkage 28 for accurately controlling the stroke of piston 68.

As will be appreciated, surges or other fluctuations in the pressure of food product supplied to fill pump 20 through product supply line 22 may result in inaccurate filling of the containers 14. As noted, this is particularly a problem when packaging metered amounts of food product which is compressible in nature. To this end, the present fill pump 20 includes a unique arrangement for compensating for any such pressure fluctuations which may occur in the supply of food product to the fill pump. Accurate product packaging requires that the pressure of food product within inlet portion 54 is maintained generally constant to assure that equal quantities of product by weight are metered by each stroke of piston pump 64.

Fill pump 20 includes a product accumulator 74 operatively associated with the pump housing 52 and preferably disposed generally above piston pump 64. Accumulator 74 includes an accumulator cylinder 76, which may be suitably fabricated from stainless steel or like material, and an accumulator piston 78 which may be suitably fabricated from Teflon or like material. Accumulator piston 78 is reciprocably disposed within accumulator cylinder 76 so that they together define an expansible chamber, designated 80, which is in communication with the interior of the product inlet portion 54 of pump housing 52. A removable back plate 81 is fitted against accumulator cylinder 76 and pump cylinder 66, and is connected with pump housing 52 by mechanical fasteners 79, which may be easily removed for disassembly and maintenance of fill pump 20.

Expansible chamber 80 is adapted to responsively receive food product from and return food product to product inlet portion 54 for compensating for surges or other fluctuations in the supply of food product to the fill pump 20. To this end, accumulator 74 preferably includes a single-acting, fluid operable biasing actuator 82 which is operated by a pressure regulator 84 (FIG. 2). Actuator 82 is operatively associated with expansible chamber 80 by connection of the actuator with accumulator piston 78 by piston rod 86. Before operation of fill pump 20, actuator 82 is set up so that it exerts a predetermined biasing force upon expansible chamber 80 which corresponds to the desired pressure of food product supplied to piston pump 64 from product inlet 54. In this way, food product is received from inlet portion 54 within expansible chamber 80 responsively to the pressure of the food product within the inlet portion. Fluctuations in the supply of food product which result in an increase in the pressure of the food product within inlet portion 54 acts to fill the chamber 80 with food product in opposition to the biasing force exerted thereon by actuator 82. A decrease in the pressure of the food product supply permits food product within the chamber 80 to return to the product stream within inlet portion 54 by the action of the predetermined biasing force of actuator 82 on chamber 80. In this unique fashion, accumulator 74 continuously compensates for variations in the pressure of food product within fill pump 20, thus assuring that generally equal quantities of food product are delivered to the containers by displacement of piston pump 64.

In order to maintain a quantity of food product within expansible chamber 80 at all times during operation for accommodating fluctuations in the food product supply, accumulator 74 includes an elongate member or projection 88 which is carried by accumulator piston 78 and extends through back plate 81 in generally parallel relation to actuator 82. Member 88 is provided for operation of automatic electrical control mechanism 90, which is operatively associated with the drive mechanism of fill pump 20, as well as with the drive mechanism of the product fill line 10. Control mechanism 90 includes first and second switches 92 and 94 which are engageable for activation by member 88. Switches 92 and 94 may comprise suitable microswitches, with the control mechanism 90 providing for selective, temporary increase or decrease in the filling speed of the fill pump 20 and the associated mechanisms of fill line 10 in the following manner.

Switches 92 and 94 of control mechanism 90 are arranged relative to member 88 such that switch 94 is normally engaged by the member 88, with switch 92 is out of engagement with member 88 (FIG. 2). In this way, a desired quantity of food product is always present within expansible chamber 80, with the biasing action provided by actuator 82 acting to accommodate or balance fluctuations in the pressure of the food product supply to the fill pump 20. However, during operation of the fill pump, the quantity of product within expansible chamber 80 may become greater or less than the above desired quantity. Such changes in the volume of product within chamber 80 are detected by switches 92 and 94, operating in association with member 88. Thus, when the volume of food product with chamber 80 is equal to or exceeds a first predetermined volume, member 88 engages switch 92 (FIG. 4). When the volume of product within chamber 80 is equal to or less than a second predetermined volume, member 88 is disengaged from switch 94 attendant to movement of accumulator piston 78 and member 88 to the left of the position in which they are illustrated in FIG. 2.

Because actuator 82 is initially adjusted to exert a constant, predetermined biasing force on accumulator piston 78, changes in the filling speed of fill pump 20 above or below a predetermined normal filling speed result in flow of food product into or from expansible chamber 80. Thus, control mechanism 90 functions to temporarily increase or decrease the filling speed of the apparatus in response to activation of switches 92 and 94. Specifically, when member 88 engages switch 92 attendant to an increase in the volume of food product within chamber 80 to the first predetermined volume, control mechanism 90 signals the drive mechanism of the fill line 10 and the fill pump 20 to increase the speed of sequential filling of containers 14. The increased filling speed is maintained until the volume of product within chamber 30 is reduced to below the first predetermined volume. The constant biasing action of actuator 82 assures that the desired generally constant product pressure is maintained in product inlet portion 54 so accurate, continuous filling of containers 14 with food product is provided. When the volume of food product within chamber 80 is reduced by the action of actuator 82 and member 88 is disengaged from switch 92, control mechanism 90 signals the fill pump and fill line drive mechanisms to resume normal filling speed.

In a like manner, control mechanism 90 functions to temporarily decrease the filling speed of the apparatus when the volume of food product with chamber 80 is at or below the second predetermined volume. Reduction of the quantity of product in chamber 80 below the second predetermined volume disengages member 88 from switch 94, whereupon control mechanism 90 signals the drive mechanisms of the fill pump and fill line to decrease the filling speed of containers 14. The decreased filling speed causes food product to enter expansible chamber 80 in opposition to the biasing action of actuator 82, and acts to move piston 78 so that member 88 re-engages switch 94. Thus, decreased filling speed is maintained until the volume of product within chamber 80 is increased to above the second predetermined volume. Engagement of member 88 with switch 94 causes control mechanism 92 to signal the apparatus to resume normal filling speed.

As will be appreciated, normal filling speed of the apparatus is maintained when the quantity of food product within chamber 80 is less than the first predetermined volume, and more than the second predetermined volume. Operation of the apparatus as described above has been found to significantly enhance the accuracy with which containers 14 are filled.

Before operation of the fill line 10, piston pump 64 is "fine tuned" so that each stroke of the pump generally corresponds to the volume of the quantity of food product to be delivered to each of the containers 14. Pressure regulator 84 is then adjusted so that actuator 82 operates through accumulator piston 78 to exert a predetermined amount of force on the expansible chamber 80 of the accumulator 74. The amount of force exerted by the actuator 82 will be a function of the compressibility of the food product being delivered to the containers 14, and will correspond to the desired pressure of the food product within the fill pump 20. The apparatus is initially adjusted so that the quantity of food product within expansible chamber 80 positions accumulator piston 78 generally as shown in FIG. 2, with engagement of member 88 only with switch 94 corresponding to operation at normal filling speed. Operation of the fill line is then commenced.

As fill pump 20 is operated, fluctuations or surges in the supply of food product to the fill pump through supply line 22 typically occur. So that inaccurate quantities by weight of food product are not delivered to containers 14, surges in the pressure of the supplied food product are compensated for by filling of expansible chamber 80 of accumulator 74 with product received from product inlet portion 54. Accumulator piston 78 is displaced from the position illustrated in FIG. 2 against the biasing force exerted by actuator 82 as the fill pump 20 continues to cyclically operate. Any decrease in the food product pressure results in a like compensating action as the predetermined force exerted by actuator 82 forces food product from chamber 80 back into inlet portion 54.

After a period of operation, expansible chamber 80 of accumulator 74 may become filled with food product (FIG. 4). Automatic control mechanism 90 is provided for control of the drive mechanism of fill line 10 so that a quantity of such "accumulated" product is returned to the product stream without appreciably altering the pressure of the food product within fill pump 20. Specifically, engagement of member 88 with switch 92 causes the control mechanism 90 to increase the filling speed of the apparatus. The biasing action of actuator 82 causes product to flow from chamber 80 back into the product stream during the increase in filling speed. This results in member 88 disengaging switch 92, and control mechanism 80 operates to signal the apparatus to resume normal filling speed. Thus, accurately metered quantities of food product are delivered to containers 14 in a continuous and uninterrupted manner.

During periods of operation of fill pump 20, fluctuations in the supply of food product can also result in the quantity of product within chamber 80 being sufficiently reduced such that elongate member 83 becomes disengaged from switch 94. When this occurs, control mechanism 90 signals the apparatus to reduce the filling speed of containers 14. This decrease in filling speed causes food product from product inlet portion 54 to enter chamber 80 against the force of actuator 82, displacing piston 78 and member 88 until member 88 reengages switch 94. Control mechanism 90 then signals the drive mechanism of fill pump 20 and fills line 10 to resume normal filling speed.

Thus, it will be appreciated that the present fill pump apparatus greatly facilitates accurate packaging of food product by maintaining generally constant product pressure within the fill pump immediately upstream of piston pump 64. The initial biasing force provided by actuator 82 upon expansible chamber 80 permits continuous compensation by the fill pump 20 for fluctuations in the pressure of food product received from supply line 22. When the volume of product within expansible chamber 30 exceeds or falls below the desired volume, operation of control mechanism 90 by elongate member 88 appropriately effects temporary changes in the filling speed of the apparatus, thus further maintaining generally constant pressure of the product within the fill pump.

As noted above, product fill line 10 typically includes a plurality of operating lines arranged side-by-side and operable in unison. In a typical operating arrangement, a plurality of fill pumps 20, each including a cyclically operable piston pump 64 and a product accumulator 74, are provided for operation in unison with each other. A like plurality of containers are simultaneously presented as a group to the pumps for filling. In such an arrangement, the control mechanisms 90 are operatively interconnected with each other so that filling of any one of the expansible chambers of the respective accumulators of the fill pumps with the first predetermined maximum volume of food product operates to increase the speed of the sequential filling of the groups of the containers by the fill line. During rotation at an increased filling speed, the biasing actuators of the accumulators of the product fill pumps force food product from the expansible chamber of each accumulator. Normal filling speed is resumed when the volume of product in all of the accumulators is reduced to below the first predetermined volume.

Similarly, when the volume of food product within any one of the accumulators provided is at or below the second predetermined volume, the interconnected control mechanisms 90 operate to increase the filling speed of the groups of containers until each accumulator contains more than the second predetermined volume of food product. Normal filling speed is then resumed. By interconnecting the control mechanism of a plurality of fill pumps 20 in this fashion, uniformity of the quantity of food product delivered by each fill pump is assured. It will be appreciated that the nature of the control mechanism 90 permits ready adjustment of the overall system, thus accommodating use of the present fill pump apparatus for packaging of a wide variety of flowable food products in a highly efficient and accurate manner.

From the foregoing, it will be observed that numerous variations and modifications may be effected without departing from the true spirit and scope of the novel concept of the present invention. It will be understood that no limitation with respect to the specific apparatus illustrated herein is intended or should be inferred. It is, of course, intended to cover by the appended claims all such modifications as fall within the scope of the claims.

What is claimed is:

1. An apparatus for sequentially filling a plurality of containers each with a quantity of flowable product, comprising:

housing means having product inlet means adapted to receive a supply of food product from an associated source, and product outlet means adapted to deliver said product to each said container;

cyclical pump means associated with said housing means adapted to alternately communicate with said product inlet means and said product outlet means for cyclically receiving said quantity of product from said inlet means and thereafter forcing the product through said outlet means;

product accumulator means, including an expansible chamber adapted to receive food product, communicating with said product inlet means for maintaining the pressure of food product within the inlet means generally constant; and control means operatively associated with said product accumulator means for increasing and decreasing the speed of the sequential filling of said containers responsively to the volume of food product in said expansible chamber.

2. The apparatus in accordance with claim 1, wherein said expansible chamber is subjected to a predetermined biasing force by biasing means which corresponds to a predetermined operating pressure for said pump means, whereby an increase in the pressure of said supply of food product above said predetermined pressure causes food product to enter said chamber against said biasing force, and a decrease in the pressure of said supply of food product below said predetermined pressure results in return of food product from said chamber to said product inlet means.

3. The apparatus in accordance with claim 2, wherein said accumulator means includes an accumulator piston reciprocably disposed within an accumulator cylinder, said accumulator piston and cylinder together defining said expansible chamber, said biasing means being operatively associated with said accumulator piston for creating said predetermined biasing force.

4. The apparatus in accordance with claim 1, wherein said product accumulator means comprises said expansible chamber and biasing means operatively associated therewith, said biasing means subjecting said chamber to a predetermined force corresponding to a predetermined operating pressure for said pump means, whereby fluctuations in the pressure of said supply of product causes product to responsively enter and flow from said chamber for maintaining generally constant product pressure in said inlet means.

5. The apparatus in accordance with claim 4, wherein said control means operate to temporarily increase the speed of the sequential filling of said containers after a first predetermined volume of food product is received within said chamber, and to temporarily decrease the speed of sequential filling of said containers when the volume of food product within said chamber is less than a second predetermined volume.

6. The apparatus in accordance with claim 4, said control means operating to increase the speed of the sequential filling of said containers by said apparatus to above a predetermined normal filling speed when a first predetermined volume of product is received within said chamber, the increased speed of the apparatus being maintained until the volume of product within said chamber is reduced to below said first predetermined volume by the action of said biasing means on said chamber, said control means further operating to decrease the speed of the apparatus below the normal filling speed when less than a second predetermined volume of product is within said chamber, the decreased speed of the apparatus being maintained until the volume of product within said chamber is increased to above said second predetermined volume, said apparatus being operated at the normal filling speed when the volume of product within said chamber is less than said first predetermined volume and greater than said second predetermined volume.

7. The apparatus in accordance with claim 4, wherein said accumulator means includes a piston reciprocably disposed within a bore, said piston and bore together defining said expansible chamber, said biasing means acting upon said piston for creating said predetermined force within said chamber.

8. The apparatus in accordance with claim 7, said control means operating to temporarily increase the speed of the sequential filling of said containers by said apparatus after a first predetermined volume of product is received within said chamber so that product is forced from said chamber by the action of said biasing means, said control means further operating to temporarily decrease the speed of the sequential filling of said containers when the volume of food product within said chamber is less than a second predetermined volume so that product enters said chamber.

9. The apparatus in accordance with claim 8, wherein said biasing means comprise a fluid ram.

10. The apparatus in accordance with claim 8, and rotary valve means disposed within said housing means intermediate said product inlet means and said product outlet means and cyclically operable for providing cyclic, alternate communication of said pump means with said product inlet means and said product outlet means, and said pump means comprising a positive displacement reciprocating pump having a displacement generally equal to said quantity of flowable product.

11. The apparatus in accordance with claim 4, wherein said apparatus includes a plurality of housing means arranged side-by-side for simultaneously filling a like plurality of containers presented as a group for filling;

said inlet means comprises an inlet portion of each housing means, and said outlet means comprises an outlet portion of each housing means, said pump means comprise a plurality of cyclically operable positive displacement reciprocating pumps respectively associated with said housing means and operable in unison, each pump being adapted to alternately communicate with the inlet and outlet portions of the respective housing means, said accumulator means comprises a plurality of expansible chambers respectively communicating with said inlet portions and said biasing means comprises a plurality of biasing arrangements respectively associated with said expansible chambers, and said control means is associated with each said expansible chamber whereby filling of any one of said expansible chambers with a first predetermined volume of product operates to temporarily increase the speed of the sequential filling of groups of said containers by said apparatus, said control means further operating to temporarily decrease the speed of the sequential filling of groups of said containers when the volume of food product within any one of said expansible chambers is less than a second predetermined volume.

12. An apparatus for sequentially filling a plurality of containers each with a quantity of flowable food product, comprising:

a housing including a product inlet portion adapted to receive a continuous supply of food product from an associated source, and a product outlet portion adapted to deliver said food product to each said container;

cyclically operable reciprocating pump means associated with said housing and having a displacement generally corresponding to the volume of said quantity of food product, whereby displacement of said pump means in one direction fills said pump means with said food product, and displacement of said pump means in an opposite direction forces said food product from said pump means;

rotary valve means cyclically operable between a first position in which said pump means and product inlet portion are placed in communication with each other as said pump means is displaced in said one direction for filling said pump means with food product from said product inlet portion, and a second position in which said pump means and said product outlet portion are placed in communication with each other as said pump means is displaced in said opposite direction for forcing said food product from said pump means through said product outlet portion;

product accumulator means communicating with said product inlet portion for responsively receiving food product from and returning received food product to said inlet portion for maintaining generally constant pressure of said food product within said inlet portion; and control means operatively associated with said product accumulator means for increasing and decreasing the speed of the sequential filling of said containers responsively to the volume of food product in said accumulator means.

13. The apparatus in accordance with claim 12, wherein said accumulator means comprises an expansible chamber defined by an accumulator piston reciprocably disposed within a cylinder, said chamber communicating with said product inlet portion, and biasing means operatively associated with said piston whereby said chamber receives product from said inlet portion when the pressure of product on said piston exceeds a predetermined force exerted on said piston by said biasing means, and product is returned from said chamber to said inlet portion when the pressure of product on said piston is less than said predetermined force exerted on said piston by said biasing means.

14. The apparatus in accordance with claim 13, wherein said control means operates after a first predetermined volume of product is received within said chamber from said inlet portion of said housing to temporarily increase the speed of sequential filling of said containers by said apparatus above a predetermined normal filling speed so that the action of said biasing means on said accumulator piston forces product from said chamber into said inlet portion, said control means further operating to temporarily decrease the filling speed of the apparatus below the normal filling speed when the volume of product within said chamber is less than a second prdetermined volume so that product is received within said chamber from said product inlet portion, said apparatus operating at the normal filling speed when the volume of product within said chamber is between said first and second predetermined volumes.

15. The apparatus in accordance with claim 13, wherein said control means includes first switch means engageable by a projection carried by said piston when said predetermined volume of product is received within said chamber, engagement of said first switch means by said projection causing said control means to increase the filling speed of the apparatus until said projection is disengaged from said first switch means, said control means further including second switch means normally engaged by said projection, said projection being disengaged from said second switch means when the volume of product within said chamber is less than said second predetermined volume whereby said control means operates to decrease the filling speed of the apparatus until said projection engages said second switch means.

16. The apparatus in accordance with claim 15, wherein said biasing means comprises a fluid operable ran extending axially of said accumulator piston, and said projection comprises an elongate member extending generally parallel to said fluid ram.

17. The apparatus in accordance with claims 13 or 16, wherein said housing is generally vertically oriented with said accumulator means positioned above said pump means.

18. The apparatus in accordance 13, wherein said accumulator means is joined to said housing immediately upstream of said rotary valve means.

19. A method of sequentially filling a plurality of containers each with a quantity of flowable food product, comprising the steps of:

providing a housing having a product inlet portion adapted to receive a supply of food product from and returning food product to an associated source, and a product outlet portion adapted to deliver the food product to each said container;

sequentially presenting said containers to said outlet portion for filling;

providing cyclically operable pump means associated with said housing;

cyclically alternately placing said pump means in communication with said inlet portion and filling said pump means with the food product, and placing said pump means in communication with said outlet portion and forcing the food product from said pump means to said outlet portion for delivery to said containers, providing accumulator means in communication with said inlet portion for responsively receiving food product from said returning food product to said inlet portion thereby maintaining generally constant food product pressure within said inlet portion; and controlling the speed of the sequential filling of said containers responsively to the volume of food product in said accumulator means.

20. The method of filling containers in accordance with claim 19, wherein said accummulator means is provided by providing an expansible chamber in communication with said inlet portion and by providing biasing means associated with the expansible chamber, whereby food product is received by and returned from said expansible chamber in response to changes in the force exerted on said expansible chamber by food product therein in opposition to a predetermined force exerted on said expansible chamber by said biasing means.

21. The method of filling containers in accordance with claim 20, wherein said controlling step includes increasing the speed of the sequential filling of said containers above a predetermined normal filling speed after a first predetermined volume of product is received within said chamber so that the action of said biasing means on said chamber forces product therefrom, the increased filling speed being maintained until the volume of product within said chamber is reduced to below said first predetermined volume, and decreasing the filling speed of the containers to below the normal filling speed when the volume of product within said chamber is less than a second predetermined volume so that product is received within said chamber in opposition to said biasing means, the decreased filling speed being maintained until the volume of product within said chamber is increased to above said second predetermined volume, and maintaining the normal filling speed of said containers when the volume of product within said chamber is more than said second predetermined volume and less than said first predetermined volume.

22. The method of filling containers in accordance with claim 21, wherein said cyclic alternate communication of said pump means with said inlet and outlet portions is provided by rotary valve means disposed within said housing cyclically operable in timed relation with said pump means, and said forces exerted upon said expansible chamber by said biasing means are provided by a fluid operable actuator associated with said expansible chamber.

* * * * *